US006590163B1

(12) United States Patent
Goto

(10) Patent No.: US 6,590,163 B1
(45) Date of Patent: Jul. 8, 2003

(54) PROTECTIVE STRUCTURE FOR TERMINAL LEAD WIRE OF COIL

(75) Inventor: Yoshihide Goto, Yamagata (JP)

(73) Assignee: Goto Electronic Co., Ltd., Yamagata (JP)

( * ) Notice: Subject to any disclaimer, the term of this patent is extended or adjusted under 35 U.S.C. 154(b) by 0 days.

(21) Appl. No.: 10/212,439

(22) Filed: Aug. 5, 2002

(30) Foreign Application Priority Data

Jan. 21, 2002 (JP) ..... 2002-011177

(51) Int. Cl.[7] ..... H01B 7/00
(52) U.S. Cl. ..... 174/135; 174/138 R; 174/154
(58) Field of Search ..... 174/135, 138 R, 174/138 F, 154, 168, 174, 176

(56) References Cited

U.S. PATENT DOCUMENTS 3,929,704 A * 12/1975 Horning ..... 427/208.4
4,356,676 A * 11/1982 Hauptman ..... 428/317.3
4,472,703 A * 9/1984 Blackman et al. ..... 310/45

* cited by examiner

*Primary Examiner*—Dean A. Reichard
*Assistant Examiner*—Jinhee J Lee
(74) *Attorney, Agent, or Firm*—Reising, Ethington, Barnes, Kisselle, P.C.

(57) ABSTRACT

In a protective structure for a terminal lead wire of a coil, there is provided an insulating member 15 at a point A of intersection between a terminal lead wire 9 at a winding end of the coil and a coil end part 7 including a terminal lead wire 5 at a winding start of the coil, so that the terminal lead wire 9 at the winding end of the coil may not get directly in contact with the coil end part 7 at the winding start. This insulating member 15 is applied to an entire area of the coil end part corresponding to the point A of intersection.

6 Claims, 4 Drawing Sheets

PROTECTIVE STRUCTURE FOR TERMINAL LEAD WIRE OF COIL

BACKGROUND OF THE INVENTION

1. Field of the Invention

The present invention relates to a protective structure for a terminal lead wire of a coil which is used in a voice coil for a speaker, a motor, a transformer and so on.

2. Description of the Related Art

A ribbon type wire (a flat type conductive wire) 1 employed in a coil as shown in FIG. 8 has been formed by rolling process. After a round conductive wire of copper, aluminum, copper-clad aluminum, etc. has been plated with an insulating coating 2, it has been flattened by a flattening roller to produce the flat type conductive wire.

Generally, the ribbon type wire 1 which has been produced by the rolling process has had such a defect that thickness of the insulating coating 2 is not uniform, but is thinner in radiused portions 3 on its both sides. Particularly in these raiused portions 3, the wire is apt to come into contact with adjacent wires and liable to be broken, and in some cases, the insulating coating 2 may be stripped off, causing an electrical short circuit.

Moreover, in a two-layered or multi-layered coil of the ribbon type wire, wire material having a generally uniform insulating coating has been employed in order to ensure insulation between the layers. Such wire,material has been produced by rolling a round conductive wire which has no insulating coating, thereafter, by removing oil as pretreatment, and then, by applying an insulating coating by electro-deposition.

In the above described two-layered or multi-layered coil of the ribbon type wire, no countermeasure has been taken for preventing friction between a terminal lead wire at a winding end of the coil and a coil end part including a terminal lead wire at a winding start which occurs at a point of intersection between them, or for preventing a damage of the insulating coating due to pressure contact or a bite between them.

Meanwhile, in a multi-layered coil of a rectangular shaped wire, there has been employed wire material which has been obtained by subjecting a round conductive wire having no insulating coating to rolling process to form a flat type conductive wire, then, by cutting both sides of the flat type conductive wire leaving an intermediate portion in a lateral direction to form a rectangular shaped wire, and by applying an insulating coating thereto.

In the above described multi-layered coil of the rectangular shaped wire or irregular shaped wire, no countermeasure has been taken for preventing friction between a terminal lead wire at a winding end of the coil and a coil end part including a terminal lead wire at a winding start which occurs at a point of intersection between them or for preventing a damage of the insulating coating due to pressure contact or a bite between them.

There has been such anxiety, in the conventional coils as described above, that an electrical short circuit resulting from the damage of the insulating coatings may happen at the point of intersection between the terminal lead wire at the winding end of the coil and the coil end part including the terminal lead wire at the winding start.

For example, in a two layered coil 4 of the conventional ribbon type wire as shown in FIGS. 5 and 6, a terminal lead wire 9 at a winding end of a second layer 8 of the coil comes into contact with a coil end part 7 at a winding start of a first layer 6 of the coil which has a terminal lead wire 5 at the winding start, at a point A of intersection between them, causing friction or a bite due to pressure contact between them. As the results, there has been such anxiety that insulating coatings on the coil end part 7 at the winding start and the terminal lead wire 9 at the winding end may be stripped off, and an electrical short circuit may occur.

On the other hand, in a conventional multi-layered coil 10 of a rectangular shaped wire as shown in FIG. 7, a terminal lead wire 12 at a winding end of an uppermost layer 11 of the coil has come into contact with a coil end part 14 of a lower layer 13 of the coil, causing friction or a bite due to pressure contact. As the results, there has been such anxiety that insulating coatings on the terminal lead wire 12 at the winding end and the coil end part 14 may be stripped off, and an electrical short circuit may occur.

In view of the above circumstances, an object of the present invention is to provide a protective structure for a terminal lead wire of a coil in which occurrence of an electric short circuit resulting from damages of insulating coatings at a point of intersection between a terminal lead wire at a winding end of the coil and a coil end part at a winding start.

SUMMARY OF THE INVENTION

In order to attain the above described object, a protective structure for a terminal lead wire of a coil according to the present invention includes an insulating member provided at a point of intersection between a terminal lead wire at a winding end of the coil and a coil end part including a terminal lead wire at a winding start of the coil.

According to the present invention, because reliable electrical insulation can be created at the point of intersection between the terminal lead wire at the winding end of the coil and the coil end part, an occurrence of a break in the insulating coating at the point of intersection will be avoided, and an electric short circuit can be completely prevented, enabling the coil having high reliability to be provided.

According to a second aspect of the invention, an insulating member is provided at a point of intersection between a terminal lead wire at a winding end of a second layer of a two layered coil and a coil end part including a terminal lead wire at a winding start of a first layer of the two layered coil.

According to the second aspect of the invention, because reliable electrical insulation can be created at the point of intersection between the terminal lead wire at the winding end of the second layer of the two layered coil and the coil end part including the terminal lead wire at the winding start of the first layer, an occurrence of a break in the insulating coating at the point of intersection will be avoided, and an electric short circuit can be completely prevented, enabling the two layered coil having high reliability to be provided.

According to a third aspect of the invention, an insulating member is provided at a point of intersection between a terminal lead wire at a winding end of an uppermost layer of a multi-layered coil and a coil end part including a terminal lead wire of lower layers of the multi-layered coil.

According to the third aspect of the invention, because reliable electrical insulation can be created at the point of intersection between the terminal lead wire at the winding end of the uppermost layer of the multi-layered coil and the coil end part including the terminal lead wire at the winding start of the lower layers, an occurrence of a break in the insulating coating at the point of intersection will be avoided, and an electric short circuit can be completely prevented, enabling the multi-layered coil having high reliability to be provided.

It is advantageous that the insulating member is provided so as to cover an entire area of the coil end part corresponding to the point of intersection between the terminal lead wire at the winding end and the coil end part at the winding start.

According to the above aspect, because the entire area of the coil end part corresponding to the point of intersection between the terminal lead wire at the winding end and the coil end part at the winding start can be fully covered with the insulating member, contact between the terminal lead wire at the winding end and the coil end part can be completely prevented, and an electrical short circuit due to a break in the insulating coating can be eliminated. Further, even in case where a wire in an irregular shape having relatively sharp edges is employed, the point of intersection can be fully covered with the insulating member. Therefore, it will be possible to manufacture a coil for particular purpose, and a coil more complicated and having higher reliability can be provided.

Further, it is preferable that the insulating member is formed in a sheet-like shape having an adhesive face to be applied to the coil end part corresponding to the point of intersection between the terminal lead wire at the winding end and the coil end part at the winding start.

According to the above aspect, it would be sufficient to apply the insulating member to the point of intersection between the terminal lead wire at the winding end and the coil end part, and a coil having high reliability and excellent productivity can be provided at a reduced cost. In addition, because the insulating member can be applied to the point of intersection like a partition between the terminal lead wire at the winding end and the coil end part, not only an occurrence of break in the insulating coating can be prevented, but also the insulating member will not be removed during production or transportation, and hence insulating function can be reliably performed.

Now, the present invention will be described in detail by way of examples referring to the drawings.

DESCRIPTION OF THE PREFERRED EMBODIMENTS

Figure 1:
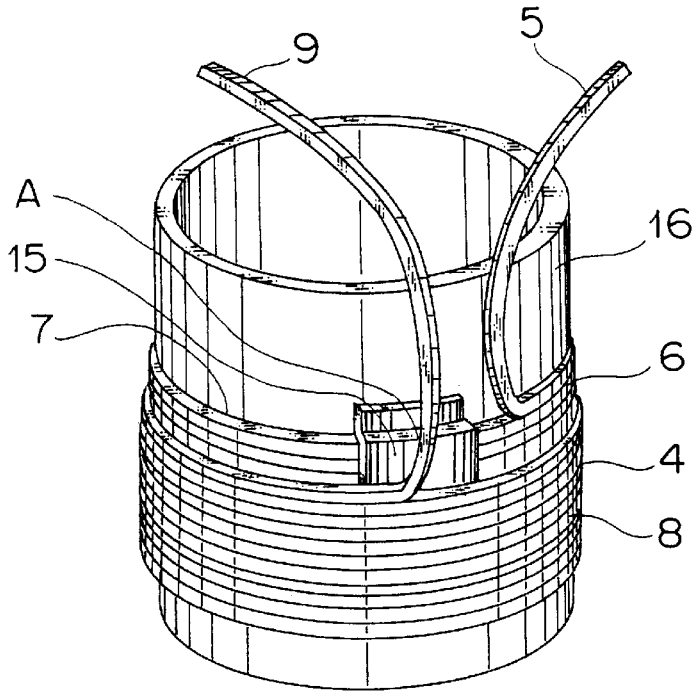
FIG. 1 is a perspective view showing a first embodiment of a protective structure for a terminal lead wire of a coil according to the present invention.
Figure 2:
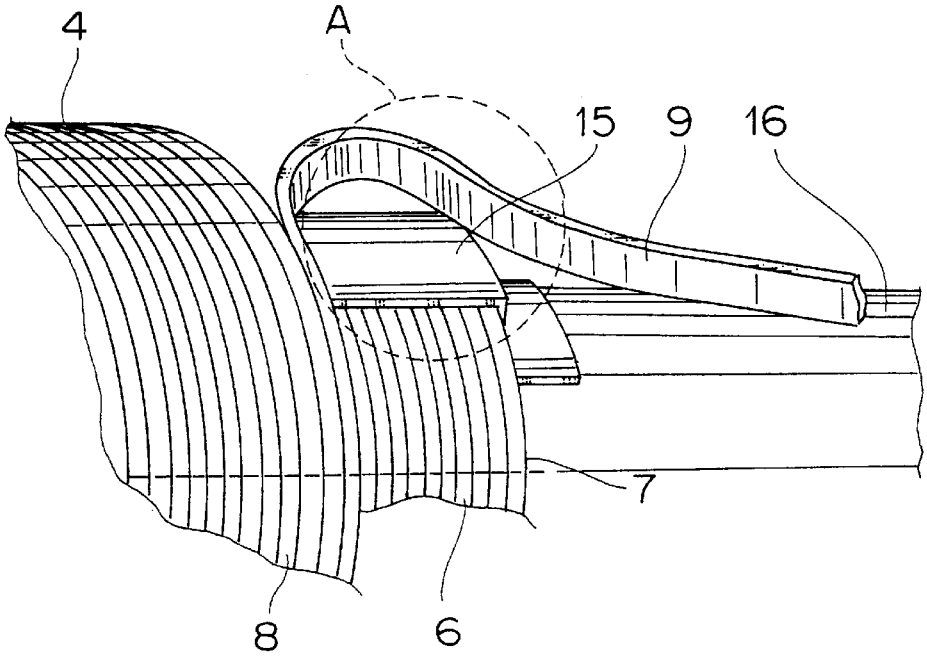
FIG. 2 is an enlarged perspective view of an essential part of FIG. 1.

FIGS. 1 and 2 show a first embodiment of a protective structure for a terminal lead wire of a coil according to the present invention. In the drawings, numeral 4 designates a two-layered coil of a ribbon type wire, numeral 5 designates a terminal lead wire at a winding start, numeral 7 designates a coil end part at a winding start of a first layer 6 of the coil, and numeral 9 designates a terminal lead wire at a winding end of a second layer 8 of the coil.

Numeral 15 designates an insulating member made of kraft paper, polyimide film or the like, and formed in a sheet-like shape having an adhesive applied to its one face. This insulating member 15 is applied so as to cover an area from the coil end part 7 at the winding start to an outer peripheral wall face of a coil bobbin 16 corresponding to a point A of intersection between the coil end part 7 and the terminal lead wire 9 at the winding end.

By thus applying the insulating member 15, the insulating member 15 is interposed between the coil end part 7 at the winding start and the terminal lead wire 9 at the winding end at the point A of intersection. Consequently, the terminal lead wire 9 at the winding end will not get directly in contact with the coil end part 7 at the winding start, and an occurrence of removal of the insulating coatings can be eliminated. Accordingly, an electrical short circuit can be prevented, and it will be possible to provide the coil having high reliability.

Then, a second embodiment will be described referring to FIG. 3.

Figure 3:
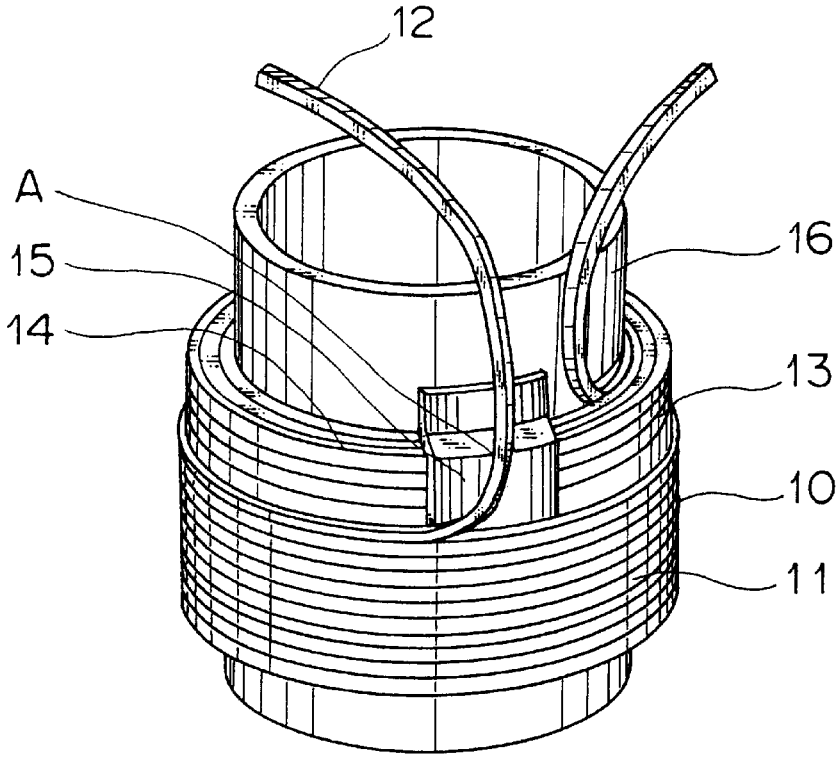
FIG. 3 is a perspective view showing a second embodiment of a protective structure for a terminal lead wire of a coil according to the present invention.

FIG. 3 shows an example of a protective structure for a terminal lead wire of a coil according to the present invention applied to a multi-layered coil 10 of a rectangular shaped wire.

In the multi-layered coil 10 of a rectangular shaped wire as shown in FIG. 3, the insulating member 15 is applied to a point A of intersection between a terminal lead wire 12 at a winding end of an uppermost layer 11 of the coil and a coil end part 14 of a lower layer 13 of the coil. In this case, the insulating member 15 is applied to an area up to the outer peripheral wall face of the coil bobbin 16 so as to completely cover the coil end part 14 of the lower layer 13 corresponding to the point A of intersection.

By thus applying the insulating member 15, the insulating member 15 is interposed between the coil end part 14 and the terminal lead wire 12 at the winding end at the point A of intersection. Consequently, the terminal lead wire 12 at the winding end will not get directly in contact with the coil end part 14, and an occurrence of removal of the insulating coatings can be eliminated. Accordingly, an electrical short circuit can be prevented, and it will be possible to provide the coil having high reliability.

Figure 4A:
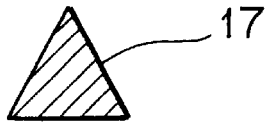
FIG. 4A is a cross sectional view of a wire having a triangular shape.
Figure 4B:
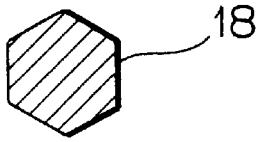
FIG. 4B is a cross sectional view of a wire having a hexagonal shape.
Figure 4C:
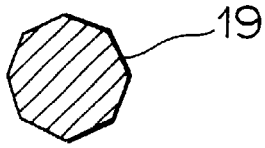
FIG. 4C is a cross sectional view of a wire having an octagonal shape.
Figure 5:
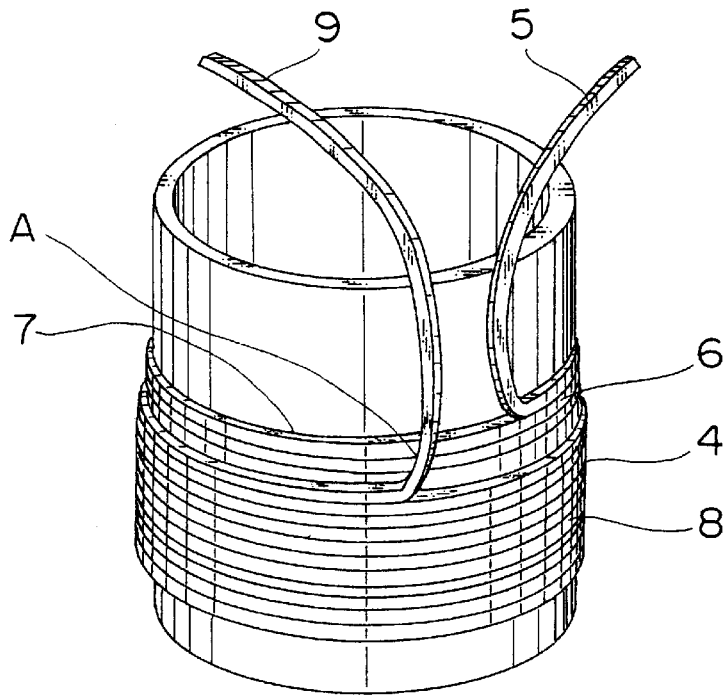
PRIOR ART FIG. 5
FIG. 5 is a perspective view of a conventional two-layered coil of a ribbon type wire.
Figure 6:
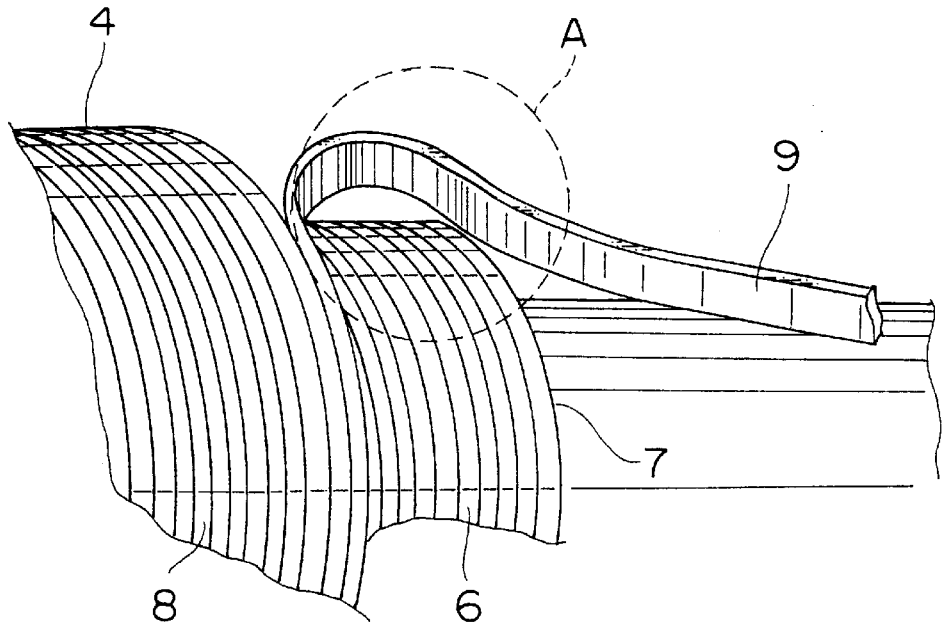
PRIOR ART FIG. 6
FIG. 6 is an enlarged perspective view of an essential part of FIG. 5.
Figure 7:
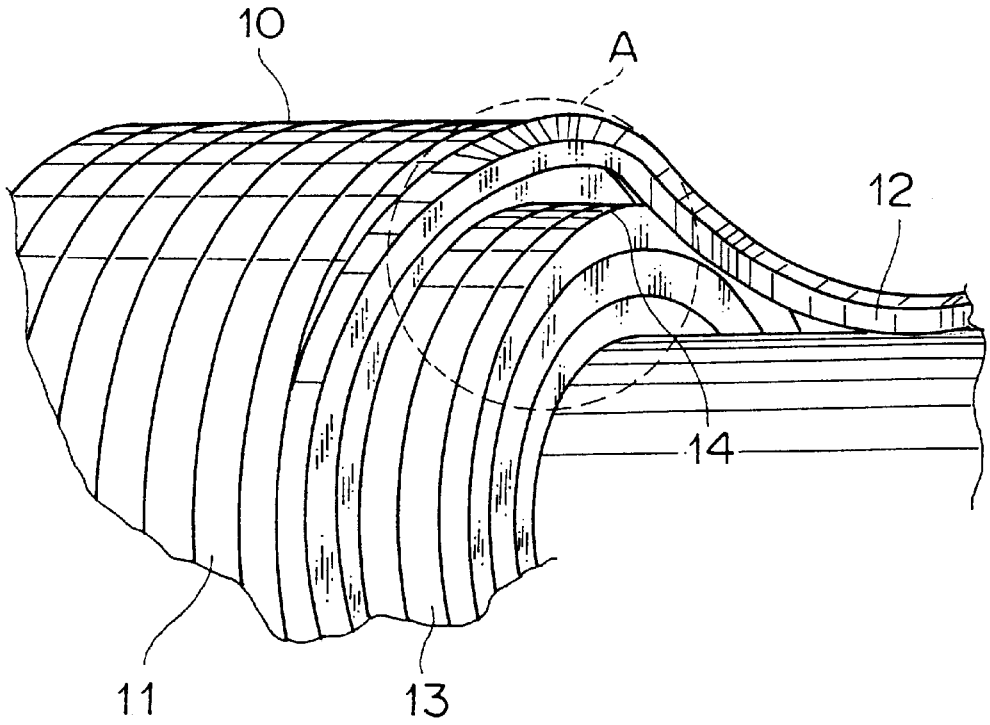
PRIOR ART FIG. 7
FIG. 7 is an enlarged perspective view of an essential part of a conventional multi-layered coil of a rectangular shaped wire.
Figure 8:
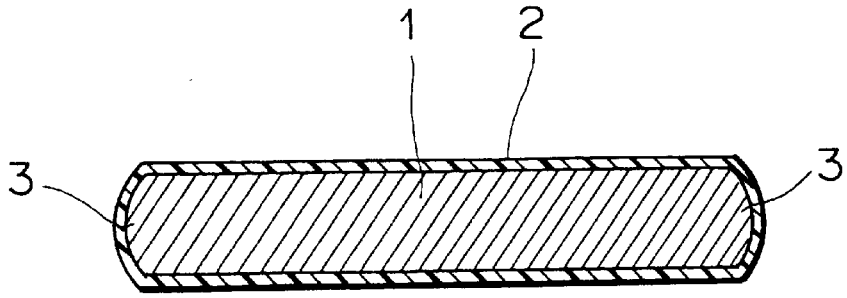
PRIOR ART FIG. 8
FIG. 8 is a cross sectional view showing an example of a wire employed in the conventional coils.

Although in the above described embodiments, the cases in which the present invention has been applied to the two layered coil of the ribbon type wire and the multi-layered coil of the rectangular shaped wire have been described, the present invention is not limited to such embodiments. For example, the present invention can be applied to a multi-layered coil employing a wire 17 having a triangular shape in cross section as shown in FIG. 4A, a wire 18 having a hexagonal shape in cross section as shown in FIG. 4B, and a wire 19 having an octagonal shape in cross section as shown in FIG. 4C.

Although the present invention has been fully described by way of examples referring to the accompanying drawings, it is to be noted that various changes and modifications will be apparent to those skilled in the art.

What is claimed is:

1. A protective structure for a terminal lead wire of a coil comprising an insulating member provided at a point of intersection between a first terminal lead wire at a winding end of said coil and a coil end part including a second terminal lead wire at a winding start of said coil, wherein said insulating member is formed in a sheet-like shape having an adhesive face to be applied to said coil end part corresponding to said point of intersection between said first terminal lead wire at said winding end and said coil end part, further including a coil bobbin on which said coil is wound, said insulating member covering an area from said point of intersection to an outer peripheral wall face of said coil bobbin.

2. A protective structure for a terminal lead wire of a coil comprising an insulating member provided at a point of intersection between a first terminal lead wire at a winding end of said coil and a coil end part including a second terminal lead wire at a winding start of said coil, wherein said insulating member is provided so as to cover an entire area of said coil end part corresponding to said point of intersection between said first terminal lead wire at said winding end and said coil end part at said winding start, wherein said insulating member is formed in a sheet-like shape having an adhesive face to be applied to said coil end part corresponding to said point of intersection between said first terminal lead wire at said winding end and said coil end part, further including a coil bobbin on which said coil is wound, said insulating member covering an area from said point of intersection to an outer peripheral wall face of said coil bobbin.

3. A protective structure for a terminal lead wire of a coil comprising an insulating member provided at a point of intersection between a first terminal lead wire at a winding end of a second layer of a two layered coil and a coil end part including a second terminal lead wire at a winding start of a first layer of said two layered coil, wherein said insulating member is formed in a sheet-like shape having an adhesive face to be applied to said coil end part, corresponding to said point of intersection between said first terminal lead wire at said winding end and said coil end part, further including a coil bobbin on which said coil is wound, said insulating member covering an area from said point of intersection to an outer peripheral wall face of said coil bobbin.

4. A protective structure for a terminal lead wire of a coil comprising an insulating member provided at a point of intersection between a first terminal lead wire at a winding end of an uppermost layer of a multi-layered coil and a coil end part including a second terminal lead wire at a winding start of a lower layer of said multi-layered coil, wherein said insulating member is formed in a sheet-like shape having an adhesive face to be applied to said coil end part, corresponding to said point of intersection between said first terminal lead wire at said winding end and said coil end part, further including a coil bobbin on which said coil is wound, said insulating member covering an area from said point of intersection to an outer peripheral wall face of said coil bobbin.

5. A protective structure for a terminal lead wire of a coil comprising an insulating member provided at a point of intersection between a first terminal lead wire at a winding end of a second layer of a two layered coil and a coil end part including a second terminal lead wire at a winding start of a first layer of said two layered coil, wherein said insulating member is provided so as to cover an entire area of said coil end part corresponding to said point of intersection between said first terminal lead wire at said winding end and said coil end part at said winding start, wherein said insulating member is formed in a sheet-like shape having an adhesive face to be applied to said coil end part corresponding to said point of intersection between said first terminal lead wire at said winding end and said coil end part, further including a coil bobbin on which said coil is wound, said insulating member covering an area from said point of intersection to an outer peripheral wall face of said coil bobbin.

6. A protective structure for a terminal lead wire of a coil comprising an insulating member provided at a point of intersection between a first terminal lead wire at a winding end of an uppermost layer of a multi-layered coil and a coil end part including a second terminal lead wire at a winding start of a lower layer of said multi-layered coil, wherein said insulating member is provided so as to cover an entire area of said coil end part corresponding to said point of intersection between said first terminal lead wire at said winding end and said coil end part at said winding start, wherein said insulating member is formed in a sheet-like shape having an adhesive face to be applied to said coil end part corresponding to said point of intersection between said first terminal lead wire at said winding end and said coil end part, further including a coil bobbin on which said coil is wound, said insulating member covering an area from said point of intersection to an outer peripheral wall face of said coil bobbin.

* * * * *